US007874453B2

(12) United States Patent
Church

(10) Patent No.: US 7,874,453 B2
(45) Date of Patent: Jan. 25, 2011

(54) SNAP LOCK CONTAINER WITH LID ROTATION TAB

(75) Inventor: John R. Church, Neshkoro, WI (US)

(73) Assignee: Spartech Corporation, Clayton, MO (US)

( * ) Notice: Subject to any disclaimer, the term of this patent is extended or adjusted under 35 U.S.C. 154(b) by 993 days.

(21) Appl. No.: 11/707,299

(22) Filed: Feb. 16, 2007

(65) Prior Publication Data

US 2007/0205206 A1 Sep. 6, 2007

Related U.S. Application Data

(60) Provisional application No. 60/774,292, filed on Feb. 17, 2006.

(51) Int. Cl.
*B65D 39/08* (2006.01)
*B65D 41/16* (2006.01)
*B65D 39/16* (2006.01)

(52) U.S. Cl. ..... 220/791; 220/298; 220/787; 220/788

(58) Field of Classification Search ..... 220/791, 220/296, 298, 787, 788, 789
See application file for complete search history.

(56) References Cited

U.S. PATENT DOCUMENTS 2,679,878 A * 6/1954 Stine ..... 220/300
3,349,950 A * 10/1967 Wanderer ..... 220/787
3,520,441 A * 7/1970 Fitzgerald ..... 206/519
5,507,406 A * 4/1996 Urciuoli et al. ..... 220/269
5,605,244 A * 2/1997 Bradshaw ..... 220/320
5,628,417 A * 5/1997 Van Halteren ..... 215/44
6,688,487 B2 2/2004 Oakes et al.
6,880,715 B2 * 4/2005 Tanabe et al. ..... 220/23.86
6,883,678 B2 * 4/2005 Chou ..... 220/793
7,124,910 B2 * 10/2006 Nordland ..... 220/839
2004/0134911 A1 * 7/2004 Padovani ..... 220/4.24
2006/0060578 A1 * 3/2006 Church et al. ..... 220/4.21
2008/0000904 A1 * 1/2008 Vovan ..... 220/266
2008/0087669 A2 * 4/2008 Boback et al. ..... 220/266

* cited by examiner

*Primary Examiner*—Anthony Stashick
*Assistant Examiner*—Niki M Eloshway
(74) *Attorney, Agent, or Firm*—Armstrong Teasdale LLP

(57) ABSTRACT

A sealed, locked, and reopenable cup and lid assembly comprises a cup, a resilient circular lid, circumferentially spaced and rotationally alignable interrupted portions and at least one tab. The resilient circular lid is sized to be inserted in a mouth of the cup and to fit in a locking groove of the cup. The resilient circular lid is permitted to be removed upon alignment of interrupted portions in the locking groove and a peripheral lip of the circular lid.

17 Claims, 6 Drawing Sheets

SNAP LOCK CONTAINER WITH LID ROTATION TAB

CROSS-REFERENCE TO RELATED APPLICATIONS

This application claims priority under 35 U.S.C. §119(e) of the co-pending U.S. Provisional Application No. 60/774,292, filed on Feb. 17, 2006 and entitled "SNAP LOCK CONTAINER WITH LID ROTATION TAB."

BACKGROUND OF THE INVENTION

The present invention relates to closable and reopenable plastic containers, and, more particularly, to such containers having a separate cup and lid which, when attached to close the container, provide a continuous seal and locked engagement, but having manually engageable tabs on the lid to facilitate relative rotational movement between the two for opening.

U.S. Pat. No. 6,688,487 describes a sealed, locked and reopenable cup and lid assembly utilizing a cup that has an open circular mouth defined by an upper edge, a radially inwardly opening locking groove below the upper edge, and a resilient circular lid that is sized to be inserted into the open mouth of the cup and which has an outer peripheral lip that is received with a snap fit in the locking groove in the cup. The locking groove and the peripheral lip include interrupted portions that are circumferentially spaced and rotationally alignable to permit removal of the lid.

The foregoing prior art cup and lid are also provided, respectively, with a frustoconical inner wall portion that extends downwardly and diverges outwardly from the locking groove and a frustoconical sealing wall that extends downwardly and diverges outwardly from the peripheral lip. The frustoconical inner wall portion of the cup is engaged by the frustoconical sealing wall of the lid as the lid is snapped into the locking groove to provide a liquid-tight seal.

When applying the foregoing technology to non-liquid or non-beverage containers, a number of problems have been encountered. First of all, the larger diameter of some containers, such as may be used at point-of-sale or for home storage and reuse, make it difficult for the user to grip the container body and rotate the lid to align the interrupted portions in the locking groove and lip to permit reopening. In addition, the liquid tight seal provided by engagement between the frustoconical inner wall of the cup and the frustoconical sealing wall of the lid may be so tight as to inhibit relative rotational movement between the lid and cup when grasped by the user. Furthermore, when the container and lid are used for dry or semi-solid storage, a dust-tight seal may be adequate and a liquid-tight seal is not necessary.

SUMMARY OF THE INVENTION

In accordance with the present invention, a sealed, locked and reopenable container and lid assembly of a circular configuration has a lid with a peripheral outwardly extending tab that may be grasped by the user to aid in opening the container. The lid tab assists in turning the lid with respect to the container when unlocking the lid from the container or for locking or relocking when the container is closed. The tab provides the user with the ability to provide additional leverage or torque to rotate the lid, the rotation of which may be made more difficult because of the high friction seal between the frustoconical wall portion of the cup and the frustoconical sealing wall of the lid. The lid tab also assists the user in breaking the seal between the lid and the container by using the tab to lift the lid.

The mouth of the container may also be provided with a similar outwardly extending lip or lips to assist the user in holding onto the container when its diameter is too large to permit the container wall to be easily grasped. When it is necessary to rotate the lid with respect to the container, when locking or unlocking, the tab or tabs assist the user by providing additional leverage for permitting the user to apply more torque and to stabilize the container against movement.

DETAILED DESCRIPTION OF THE PREFERRED EMBODIMENTS

Figure 1:
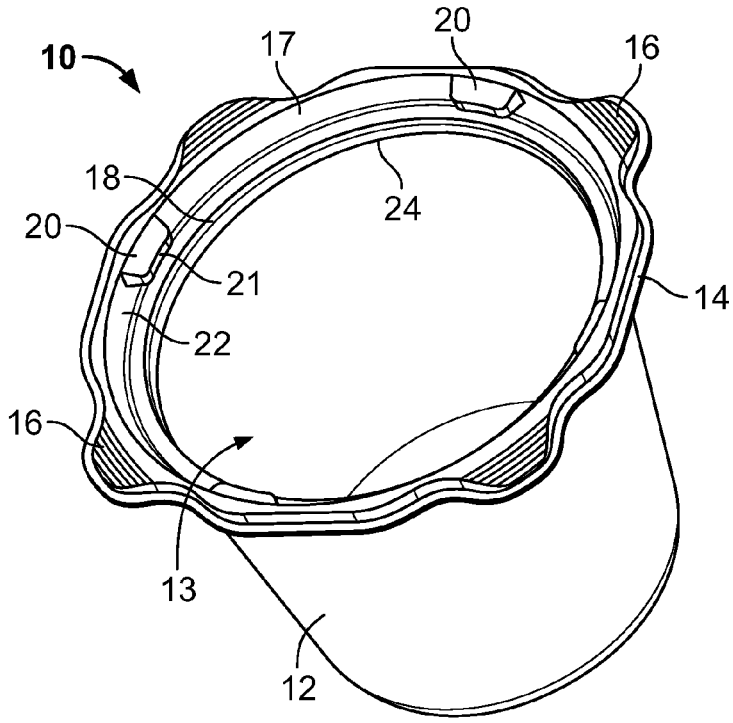
FIG. 1 is a top perspective view of a container of the present invention.
Figure 2:
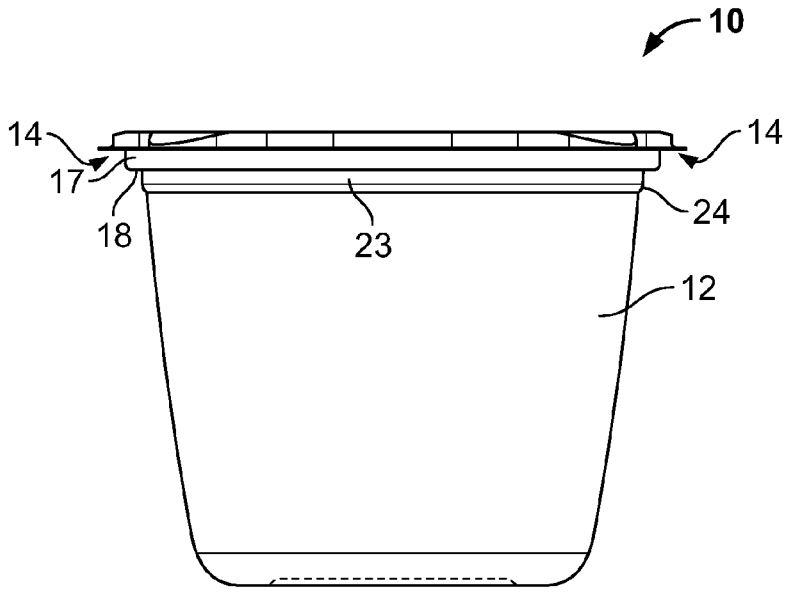
FIG. 2 is a side elevation view of the container of FIG. 1
Figure 3:
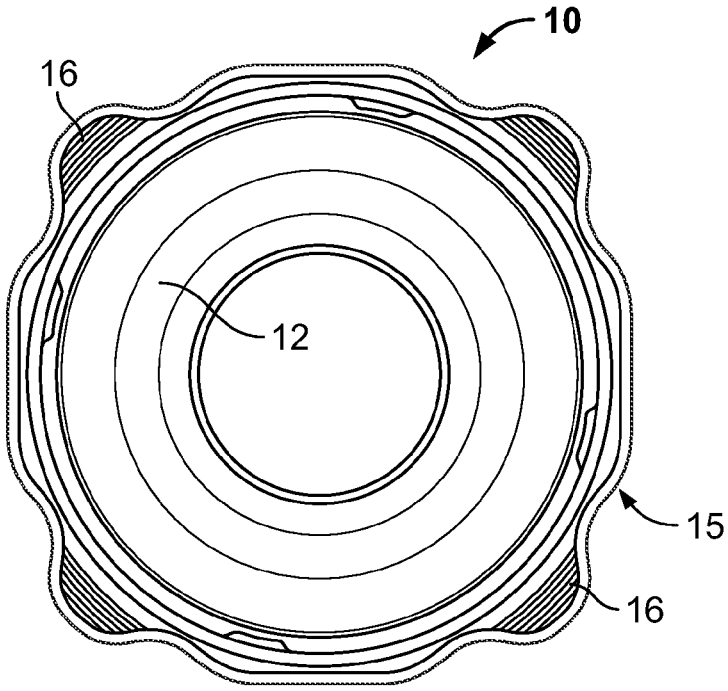
FIG. 3 is a top plan view of the container shown in FIG. 1.
Figure 4:
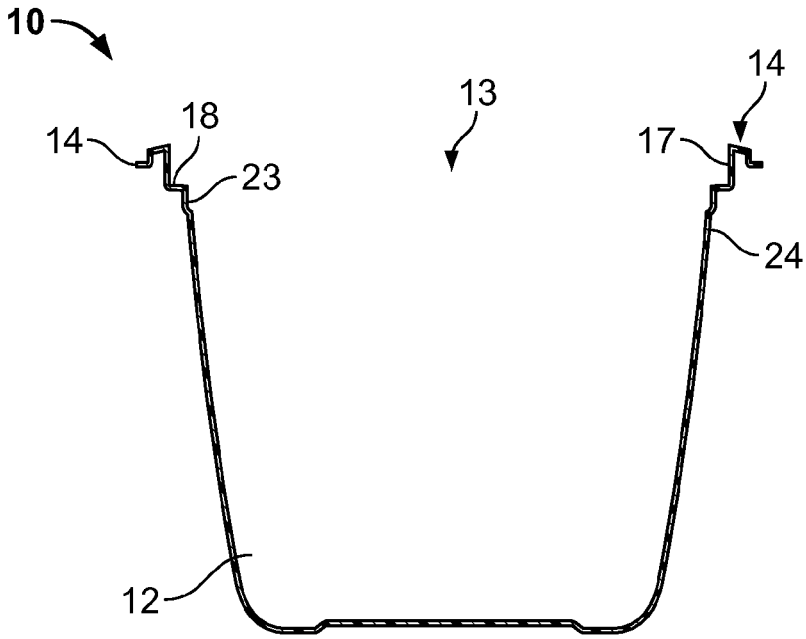
FIG. 4 is a vertical section through the container of FIG. 1.
Figure 5:
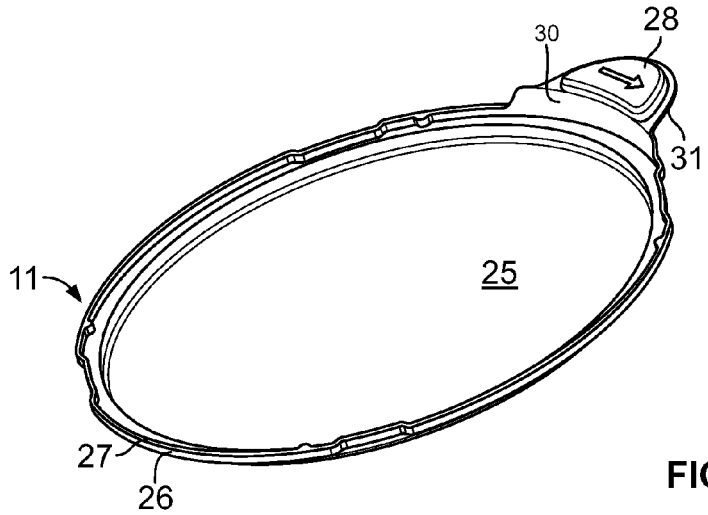
FIG. 5 is a bottom perspective view a lid for use with the container shown in FIGS. 1-4.
Figure 6:
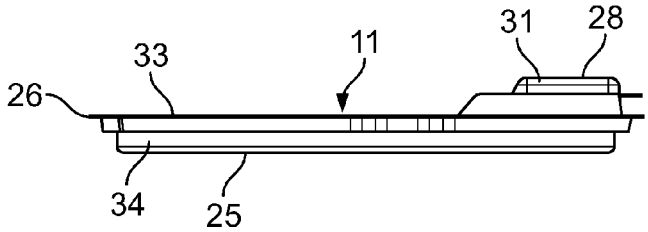
FIG. 6 is a side elevation view of the lid shown in FIG. 5
Figure 7:
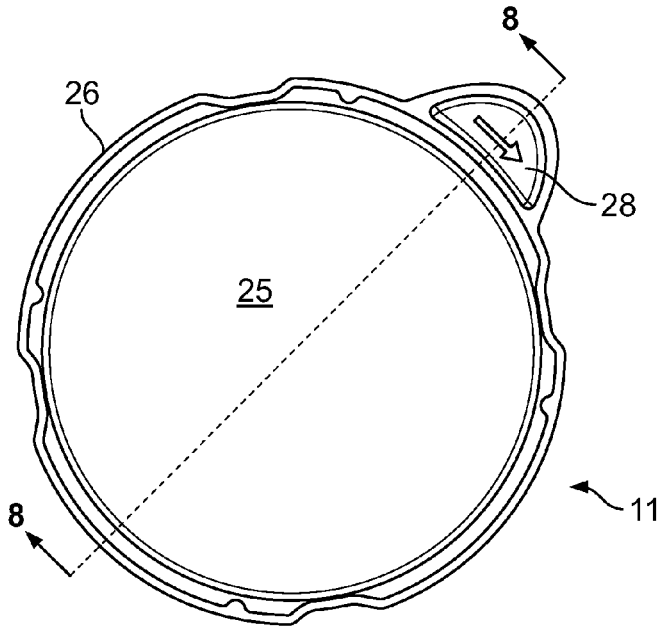
FIG. 7 is a top plan view of the lid.
Figure 8:
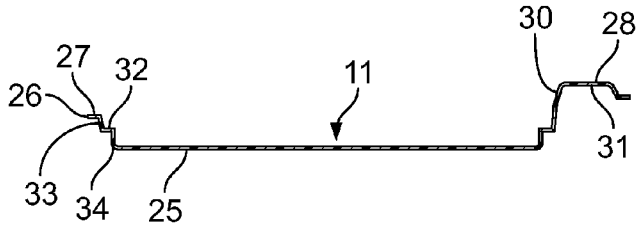
FIG. 8 is a sectional view taken on line A-A of FIG. 7.

A perspective view of a container 10 forming a part of the assembly of the present invention is shown in FIG. 1. A lid 11 for enclosing the container is shown in a perspective view in FIG. 5. The container 10 and lid 11 are preferably thermoformed of a suitable plastic material, but other molding methods may also be used. Any of the well known and commonly used thermoforming plastic resins may be utilized, including PET and polystyrenes, among others. The container 10 and lid 11 are thus of a type commonly used in the food service industries and at home for the storage of food products. The products for which the container and lid may be used may include liquid, semi-solid and solid foods.

The container 10 includes a lower body 12 which, in the embodiment shown, has a smooth frustoconical shape. The container has an open circular mouth 13 defined by a rounded inner rim 14 from which extends outwardly an undulating edge 15. In the embodiment shown, the outer edge 15 defines four circumferentially spaced tabs 16.

The rim 14 defines the upper edge of a cylindrical and generally vertical inner first wall portion 17 which is joined at its lower edge by an annular generally horizontal second wall portion 18 that extends radially inwardly from the vertical first wall portion 17. The vertical first wall portion 17 is also provided with a series of circumferentially spaced locking protrusions 20, of which there are four in number and each of which slopes inwardly and downwardly from the rim 14 to provide lead-ins 21 to facilitate attachment of the lid 11 as will be described below. Each of the locking protrusions 20 has a flat lower surface that is spaced vertically above the second horizontal wall portion 18 to define therewith a locking groove 22 for the lid 11.

Joined integrally to the inner edge of the second wall portion 18 and extending downwardly and slightly outwardly therefrom is an inner third wall portion 23 having a slight frustoconical shape with a draft angle or angle of divergence from the vertical of, for example, 1.5°. A small annular shoulder 24 separates the third wall portion 23 from the container body 12.

Referring also to FIGS. 5-8, the lid 10 has a generally flat central body 25 and a compound peripheral lip 26 that provides locking engagement with the mouth 13 of the container and, optionally, to also provide a tight seal. Most of the entire circumference of the lip 26 of the lid comprises a generally flat upper lip surface 27. However, the upper lip surface 27 includes at least one integral tab 28 which extends radially upwardly and outwardly from the lip 26. The tab 28 includes a generally vertical connection piece 30 and a generally horizontal tab body 31, the latter configured and positioned to be easily grasped between the thumb and finger of a user.

The lip 26 also includes a horizontal lower lip surface 32 that is connected to the upper lip surface 27 by a generally vertical intermediate surface 33. The inner edge of the horizontal lower lip surface 32 is joined to a generally vertical, but slightly frustoconical sealing wall 34, that diverges downwardly and outwardly at a small draft angle of, for example, 3°. The lower edge of the sealing wall 34 is integrally connected to the lid body 25. To secure the lid 11 to the container 10, the lid is placed in the mouth 13 and pressed vertically downward. The compound peripheral lip 26 has a diameter greater than the minimum diameter defined by the locking protrusions 20 that extend inwardly from the upper first wall portion 17 of the container 10. Downward movement of the lid will cause resilient inward deflection of the upper lip surface 27 as it passes over the lead-in surfaces 21 of the locking protrusions 20. As the outermost edge of the upper lip surface 27 reaches the lower edges of the locking protrusions 20, the entire lip 26 snaps into the locking groove 22 which is dimensioned to cause the upper lip surface 27 to bear on the undersurfaces of the protrusions. Correspondingly, the lower lip surface 32 bears on the horizontal second wall portion 18 of the container 10.

As the lip 26 of the lid 11 moves downwardly into the container mouth 13, the third wall portion 23 of the container is engaged by the sealing wall 34 on the lid. When the lip has snapped into the locking groove 22 under the locking protrusions 20, a seal is simultaneously formed between the third wall portion 23 and the sealing wall 34.

To permit the lid 11 to be removed from the container 10, an unlocking and reopening feature is also provided. The peripheral lip 27 of the lid 11 is provided with recesses 35 that are spaced circumferentially and dimensioned to correspond to the position and size of the locking protrusions 20 of the container. The recesses 35 extend into the lower horizontal lip surface 32. When the recesses 35 are rotationally aligned with the locking protrusions 20, as by the user holding the container in one hand and grasping and turning the lid tab 28, the lid may be lifted by the tab 28 and removed from the container. Once the recesses 35 are aligned with the locking protrusions 20, only the interference fit between the frustoconical sealing surfaces 23 and 34 need be overcome. Relative rotation between the lid 11 and the container 10 may also be facilitated by the user grasping one of the container tabs 16 to hold the container while the lid tab 28 is grasped to rotate the lid to the opening position. Regardless of where the lid tab 28 is positioned on the container in the locked position, one of the four container tabs 16 will be conveniently located to permit the user to apply the most advantageous leverage for rotating the lid.

Figure 9:
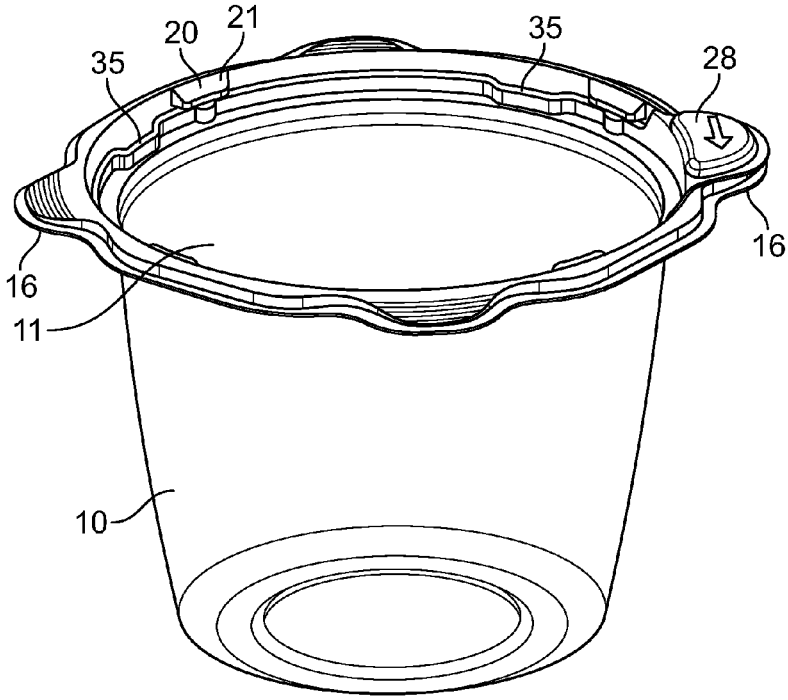
FIG. 9 is a photo of the assembled container and lid of FIGS. 1-8.
Figure 10:
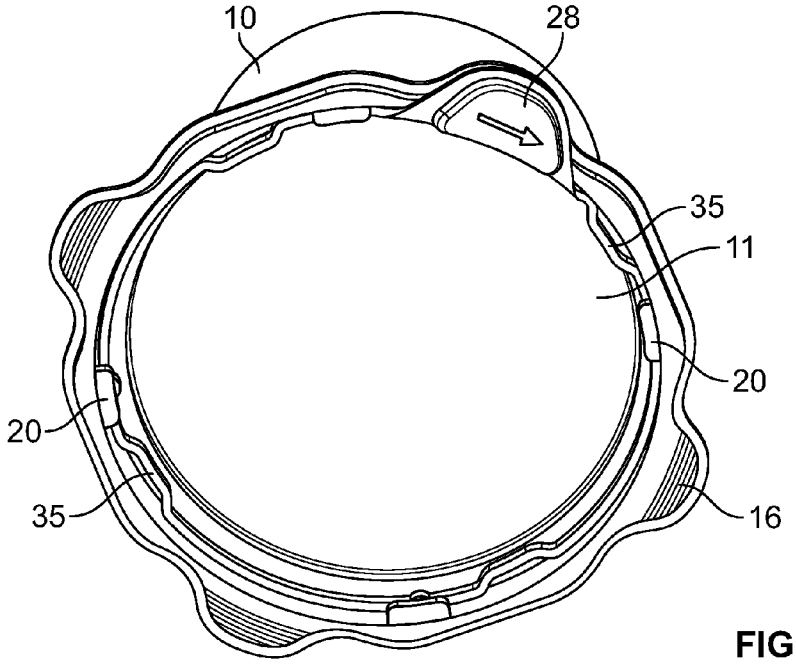
FIG. 10 is another photo of the assembled container and lid of FIGS. 1-8.
Figure 11:
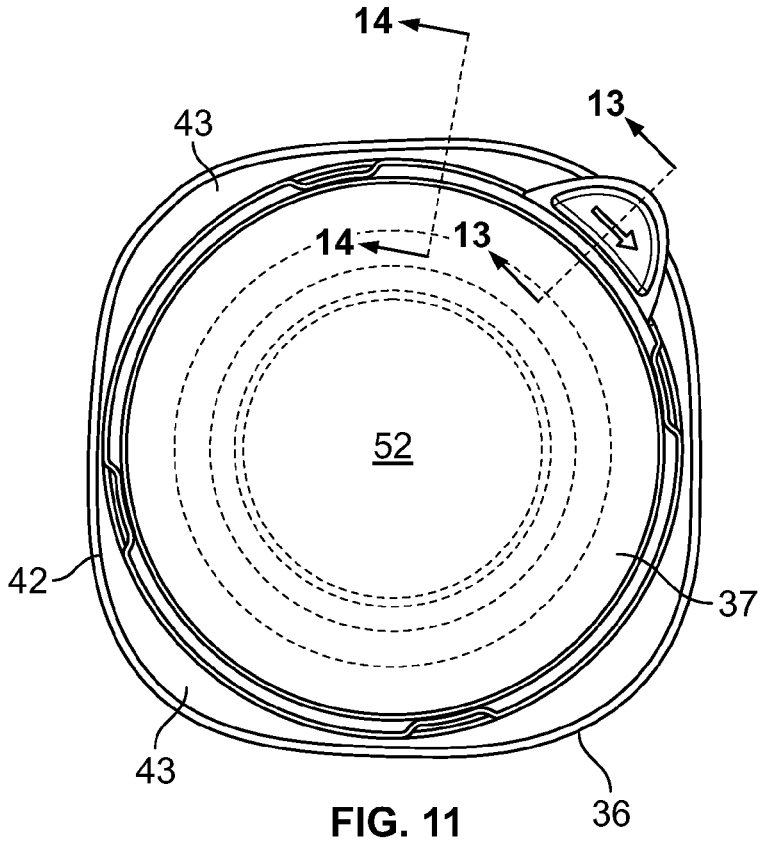
FIG. 11 is a top plan view of an assembled container and lid of an alternate embodiment of the invention.
Figure 12:
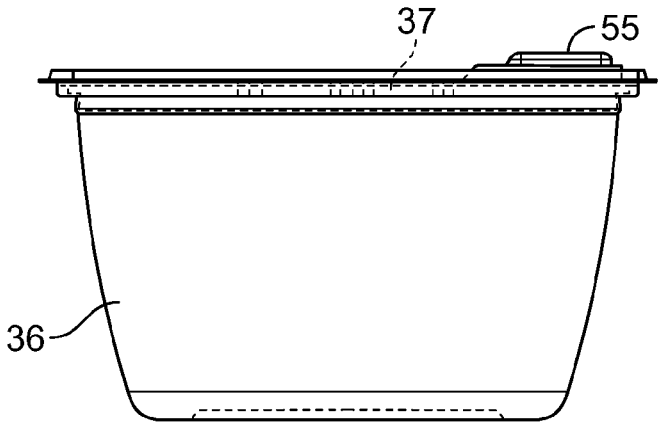
FIG. 12 is a side elevation view of the assembled container and lid of FIG. 12.
Figure 13:
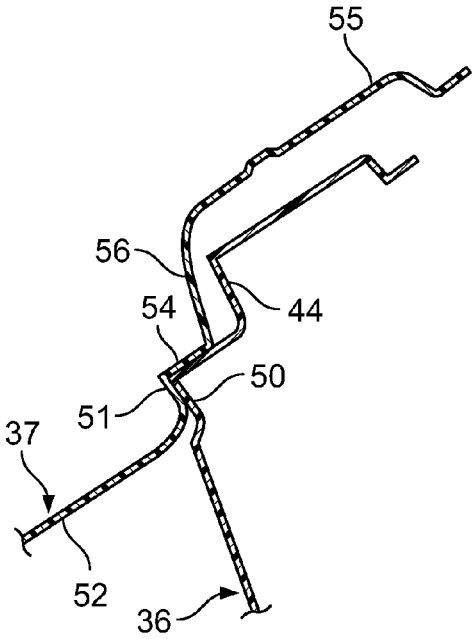
FIG. 13 is an enlarged partial sectional view taken on line A-A of FIG. 11.
Figure 14:
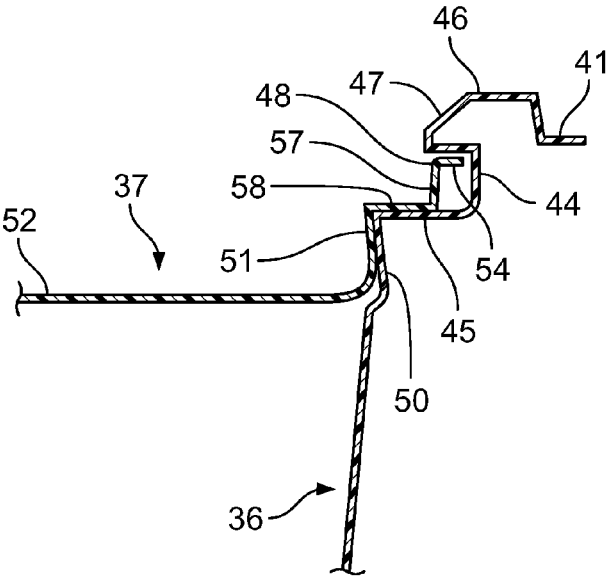
FIG. 14 is an enlarged partial sectional view taken on line B-B of FIG. 11.
Figure 15:
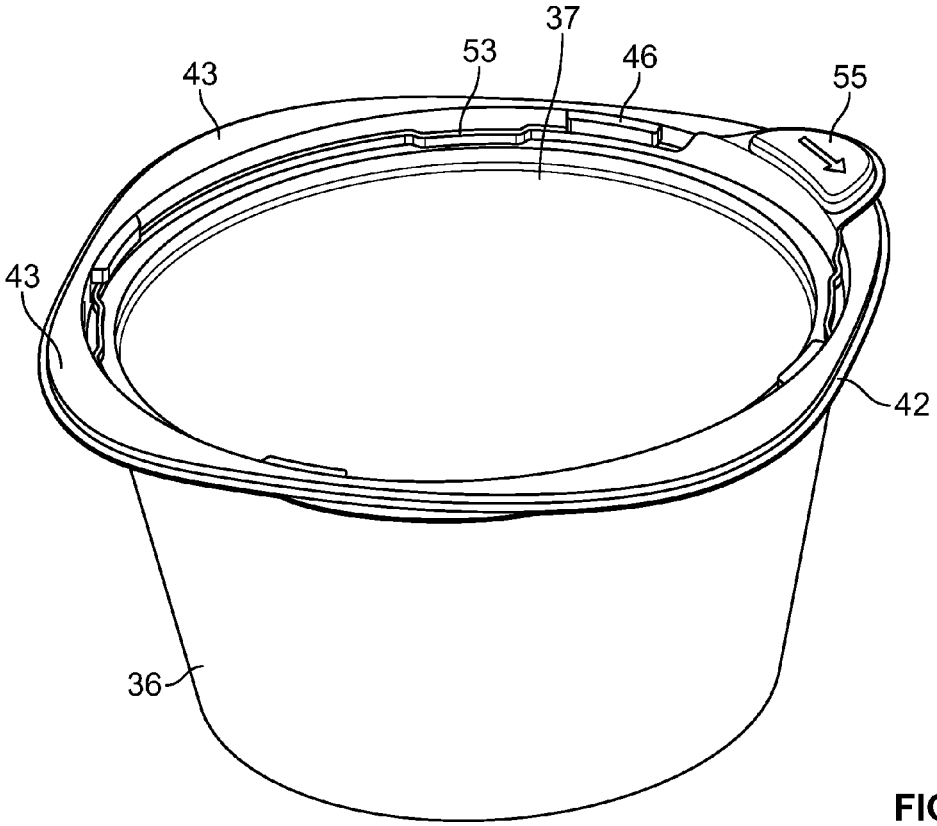
FIG. 15 is a photo of the assembled container and lid of FIGS. 11-14.

FIGS. 9 and 10 show perspective views of a locked assembly of a container 10 and lid 11.

Referring now to FIGS. 11-15, a modified embodiment of the invention is shown. The container 36 and lid 37 are attached in the same manner as in the previously described embodiment. In this embodiment, the container body 38 is generally similar to the previously described embodiment. The mouth 40 of the container similarly has a compound rim 41, however, the outer peripheral edge 42 has, in plan, a generally square shape with large radiused corners 43. The corners 43 extend outwardly from the container body to provide tabs that perform the same function as the container tabs 16 of the previously described embodiment. In other words, one of the radiused corners 43 may be grasped by the user to facilitate removal of the lid 37.

The container rim 41 includes an inner generally vertical first wall portion 44 joined at its lower edge by an annular second wall portion 45 that extends radially inwardly from the vertical first wall portion. As in the previously described embodiment, the vertical first wall portion 44 also includes a series of circumferentially spaced locking protrusions 46. The locking protrusions 46 are provided with tapered lead-ins 47. The undersurfaces of the locking protrusions and the second wall portion 45, interconnected by the first wall portion 44, provide a locking groove for the lip 48 of the lid 37. Furthermore, downwardly divergent third wall portion 50 in the container 36 and a frustoconical wall portion 51 on the lid 37 interengage to provide a sealing feature similar to that of the previously described embodiment.

The lid 37 has a flat body 52 and a stepped lip 48 as in the previously described embodiment. The lip 48 includes an upper lip surface 54 having a circular outer edge that extends nearly the entire circumference of the lid. However, the upper lip surface 54 is interrupted by a finger tab 55 that is spaced vertically above the container rim 41 and connected thereto with an upwardly divergent connection piece 56.

The lip 48 of the lid 37 includes a generally cylindrical intermediate surface 57 which connects at its lower edge to a lower lip surface 58, and which together form the compound lip that enters and is held in the locking groove 49. Recessed portions 53 in the lip 48 may be rotationally aligned with the locking protrusions 46 for lid removal as previously described.

The attachment of the lid 37 to the container 36 and its rotation relative thereto by utilizing the tab 55 is functionally the same as in the previously described embodiment. It should be noted, however, that by changing very slightly certain of the dimensions of the interengaging container and lid portions, such as the diameter of one or the other of the third wall portion 50 and sealing wall portion 51 or their respective draft angles, the seal between their abutting faces may be varied considerably or even eliminated. Thus, for liquid contents, it may be desirable to have a very tight interference fit to provide a liquid-tight seal. In this case, the rotational tab 55 on the lid 37 and the radiused corners 43 on the rim of the container may be especially useful in facilitation rotation and in lifting the lid from the container. On the other hand, if it is only desired to keep the contents dust-free, a liquid-tight seal may be unnecessary and the interference fit between sealing surfaces 50 and 51 may be reduced considerably.

I claim:

1. A sealed, locked and reopenable cup and lid assembly comprising:

a cup having an open circular mouth defined by an upper edge, an inwardly opening locking groove below the upper edge and a frustoconical inner wall portion extending downwardly and diverging outwardly from the locking groove;

a resilient circular lid sized to be inserted into the open mouth of the cup and having an outer peripheral lip received with a snap fit in said locking groove, and a frustoconical sealing wall extending downwardly and diverging outwardly from the peripheral lip and sealingly engaging said frustoconical wall portion;

circumferentially spaced and rotationally alignable interrupted portions in said locking groove and said peripheral lip which when aligned permit removal of the lid; and at least one tab extending radially from the outer peripheral lip of the lid, said at least one tab comprising a vertical connection piece and a generally horizontal tab body.

2. The assembly as set forth in claim 1 wherein a circumferential force applied to the tab rotates the lid to align the interrupted portions in said locking groove and said peripheral lip.

3. The assembly as set forth in claim 1 wherein said locking groove is defined by a plurality of protrusions extending radially inwardly from the upper edge of the cup and an annular horizontal cup wall portion below and spaced from the protrusions.

4. The assembly as set forth in claim 3 wherein the outer peripheral lip of the lid comprises generally horizontal upper and lower lip surfaces interconnected by a generally vertical intermediate lip surface;

said protrusions have generally coplanar lower surfaces; and, said peripheral lip is captured in said locking groove by engagement of said upper and lower surfaces of the lip with the lower surfaces of said protrusions and the horizontal wall portion respectively.

5. The assembly as set forth in claim 4 wherein said interrupted portions in said lid peripheral lip comprise recesses corresponding to the protrusion on the cup upper edge permitting reopening movement of the lid past the protrusions.

6. The assembly as set froth in claim 1 further comprising at least one tab extending radially outward from the circular mouth of the cup.

7. A sealing and locking cup and lid assembly comprising:

a cup having an open circular mouth defined by a cylindrical generally vertical inner first wall portion, an annular generally horizontal second wall portion extending radially inwardly from the lower edge of said first wall portion, a plurality of locking protrusions spaced circumferentially around and extending radially inwardly from said first wall portion, said protrusions having generally coplanar lower surfaces spaced vertically above said horizontal second wall portions, and a frustoconical generally vertical inner third wall portion extending downwardly and diverging outwardly from the inner edge of said second wall portion;

a resilient circular lid sized to fit within the open mouth of the cup and having an outer peripheral lip arrangement, a frustoconical generally vertical sealing wall extending downwardly and diverging outwardly from a radially inner edge of said lip arrangement;

circumferentially spaced and rotationally alignable interrupted portions in said locking groove and said peripheral lip;

at least one tab extending radially outwards from the outer peripheral lip, said at least one tab comprising a vertical connection piece and a generally horizontal tab body;

whereby in response to vertical downward insertion of the lid into the mouth of the cup, the lip arrangement is inwardly deflected by contact with said locking protrusion and is locked between the lower surfaces thereof and the horizontal second wall portion of the cup, and whereby the lid is permitted to be removed by aligning the interrupted portions in said locking groove and peripheral lip by applying a circumferential force to at least one tab.

8. The assembly as set forth in claim 7 wherein said lip arrangement comprises generally horizontal upper and lower lip surfaces joined by a frustoconical downwardly convergent connecting surface.

9. The assembly as set forth in claim 8 wherein said locking protrusions have upper lead-in surfaces that extend radially inwardly and downwardly from the upper edge of said first wall portion.

10. The assembly as set forth in claim 7 comprising recesses formed in said lip arrangement and positioned circumferentially to correspond to said locking protrusions, said recesses providing clearance for said protrusions when aligned therewith to permit the lid to be removed from the cup.

11. The assembly as set forth in claim 10 wherein said recesses are defined by continuous recessed portions of the upper lip and connecting surface of said lip arrangement.

12. The assembly as set forth in claim 7 wherein said lid further comprises a raised center body joined along an outer peripheral edge to the lower edge of the sealing wall.

13. The assembly as set forth in claim 12 including an annular connecting surface joining the center body of the lid to the sealing wall.

14. The assembly as set forth in claim 12 wherein said lid body includes a generally frustoconical outer wall surrounding a generally flat center surface.

15. The assembly as set forth in claim 14 wherein said outer wall includes tactile depressions adapted to be engaged by the fingers of a user to facilitate relative rotation of the lid with respect to the cup.

16. A multi-sealing, multi-locking, reopenable cup and lid assembly comprising:

a cup having an open circular mouth including an internal upper region defining a first half of a primary locking mechanism and a first half of a secondary sealing surface, and a contiguous internal lower region defining a first half of a primary sealing surface and a first half of a secondary locking mechanism;

a resilient circular lid insertable into said open mouth and having an outer peripheral lip region defining a second half of the primary locking mechanism and a second half of the secondary sealing surface, and a contiguous inner lip region defining a second half of the primary sealing mechanism and a second half of the secondary locking mechanism; and, at least one tab extending radially outwards from the peripheral lip, the at least one tab comprising a vertical connection piece and a generally horizontal tab body;

said lid being rotatable within the cup mouth by applying a force to the at least one tab to rotate the lid from a fully locked and sealed position to a position disengaging said primary locking mechanism and permitting manual override of said secondary locking mechanism for removal of the lid.

17. The assembly as set forth in claim 16 further comprising at least one tab extending radially outward from the circular mouth of the cup.

* * * * *